US006913178B2

(12) United States Patent
Huang

(10) Patent No.: US 6,913,178 B2
(45) Date of Patent: Jul. 5, 2005

(54) TAPE DISPENSER FOR INSTALLATION OF MULTI-ROLL

(76) Inventor: Harrison Huang, No. 23, Lin T'So Rd., Sheng Kang Hsian, Taichung Hsien (TW), 429

( * ) Notice: Subject to any disclaimer, the term of this patent is extended or adjusted under 35 U.S.C. 154(b) by 84 days.

(21) Appl. No.: 10/431,530

(22) Filed: May 8, 2003

(65) Prior Publication Data

US 2004/0222248 A1 Nov. 11, 2004

(51) Int. Cl.[7] ..... B26F 3/02; B65H 35/07

(52) U.S. Cl. ..... 225/35; 225/24; 225/51; 225/79; 225/82; 242/388.6; 242/396.3

(58) Field of Search ..... 225/34–35, 46–47, 225/51–52, 79, 82, 87, 106; 83/650; 242/255–263, 423.1–423.2, 594.3; 192/65, 70.28, 107 C, 223; 188/71.5, 1.12, 18 A; 411/160, 163–164; 221/121, 133

(56) References Cited

U.S. PATENT DOCUMENTS

| | | | | | |
|---|---|---|---|---|---|
| 17,396 | A | * | 5/1857 | Adams | 114/47 |
| 224,010 | A | * | 2/1880 | Gilson | 225/77 |
| 958,062 | A | * | 5/1910 | Adkins | 242/423.1 |
| 1,557,887 | A | * | 10/1925 | Sheeley | 242/423.1 |
| 2,456,660 | A | * | 12/1948 | Werner | 225/35 |
| 2,589,587 | A | * | 3/1952 | Weaklend et al. | 225/43 |
| 3,072,357 | A | * | 1/1963 | Sprague et al. | 242/594.3 |
| 3,635,383 | A | * | 1/1972 | Waltz | 225/37 |
| 3,907,229 | A | * | 9/1975 | Iannucci et al. | 242/129.8 |
| 4,121,785 | A | * | 10/1978 | Quenot | 242/396.9 |
| 5,011,059 | A | * | 4/1991 | Jennings et al. | 225/35 |
| 5,082,159 | A | * | 1/1992 | Gutierrez | 225/34 |
| 5,145,058 | A | * | 9/1992 | Lee | 200/517 |
| 5,215,240 | A | * | 6/1993 | Berg et al. | 225/16 |
| 5,975,394 | A | * | 11/1999 | Shuval | 225/106 |
| 6,612,473 | B1 | * | 9/2003 | Newby et al. | 225/48 |
| 6,612,474 | B2 | * | 9/2003 | Shah | 225/51 |
| 6,729,512 | B1 | * | 5/2004 | Leighton | 224/269 |
| 2004/0149798 | A1 | * | 8/2004 | Hoffman et al. | 225/46 |

* cited by examiner

*Primary Examiner*—Allan N. Shoap
*Assistant Examiner*—Carolyn Blake
(74) *Attorney, Agent, or Firm*—Bacon & Thomas, PLLC

(57) ABSTRACT

A tape dispenser for two or more tape rolls installed therein includes a housing having a first casing and a second casing coupled with each other in which a chamber is formed and a roll mount is provided in the chamber, wherein the housing has an outlet and a cutter mount at where a cutter is mounted. Three disks are installed on the roll mount between each two of the tape rolls, wherein the disk has flexible arms with blocks thereon to be against the neighboring tape rolls respectively such that the disks serve as separators to keep the tape rolls from each other. A button is movably installed on the second casing having four driving to pressing the tape roll, whereby the disks serve as brakes to keep the tape rolls still.

9 Claims, 3 Drawing Sheets

TAPE DISPENSER FOR INSTALLATION OF MULTI-ROLL

BACKGROUND OF THE INVENTION

1. Field of the Invention

The present invention relates generally to a tape dispenser, and more particularly to a tape dispenser in which two or more tape rolls are installed.

2. Description of the Related Art

A conventional tape dispenser mainly consists of a housing and a cutter, wherein only a tape roll is installed in the housing. This tape dispenser is inconvenient for users in several conditions, such as there must be several types of dispensers prepared for different needs of tapes needed in tasks or there always is a problem to find a backup tape roll when the old one has been running out.

There was a conventional tape dispenser in which two or more tape rolls are installed. In such dispenser, two or more tapes are always pulled out together while user only pull one of the tapes out.

Sometime when the cutter cut the tape off, a tension of the tape will make the tape roll rotating backwards and make the tape's tail running back on the tape roll. Sometime the tape roll also will rotate backwards because of its own weight or exerted by an unexpected force. That is very inconvenient to next time use.

SUMMARY OF THE INVENTION

The primary objective of the present invention is to provide a tape dispenser in which two or more tape rolls are installed and all of the tape rolls are ready for use.

The secondary objective of the present invention is to provide a tape dispenser, which the tape rolls are operated independently.

According to the objective of the present invention, a tape dispenser for two or more tape rolls installed therein, comprising a housing having a first casing and a second casing coupled with each other in which a chamber is formed and a roll mount is provided in the chamber; wherein the housing has an outlet and a cutter mount on which a cutter is mounted and the cutter has a blade portion at an end thereof that projects out of the housing, and at least a disk having a hole at a center thereof to be engaged with the roll mount, wherein the disk has blocks respectively at opposite sides thereof to be against the tape rolls respectively to separate the tape roll.

DETAILED DESCRIPTION OF THE INVENTION

Figure 1:
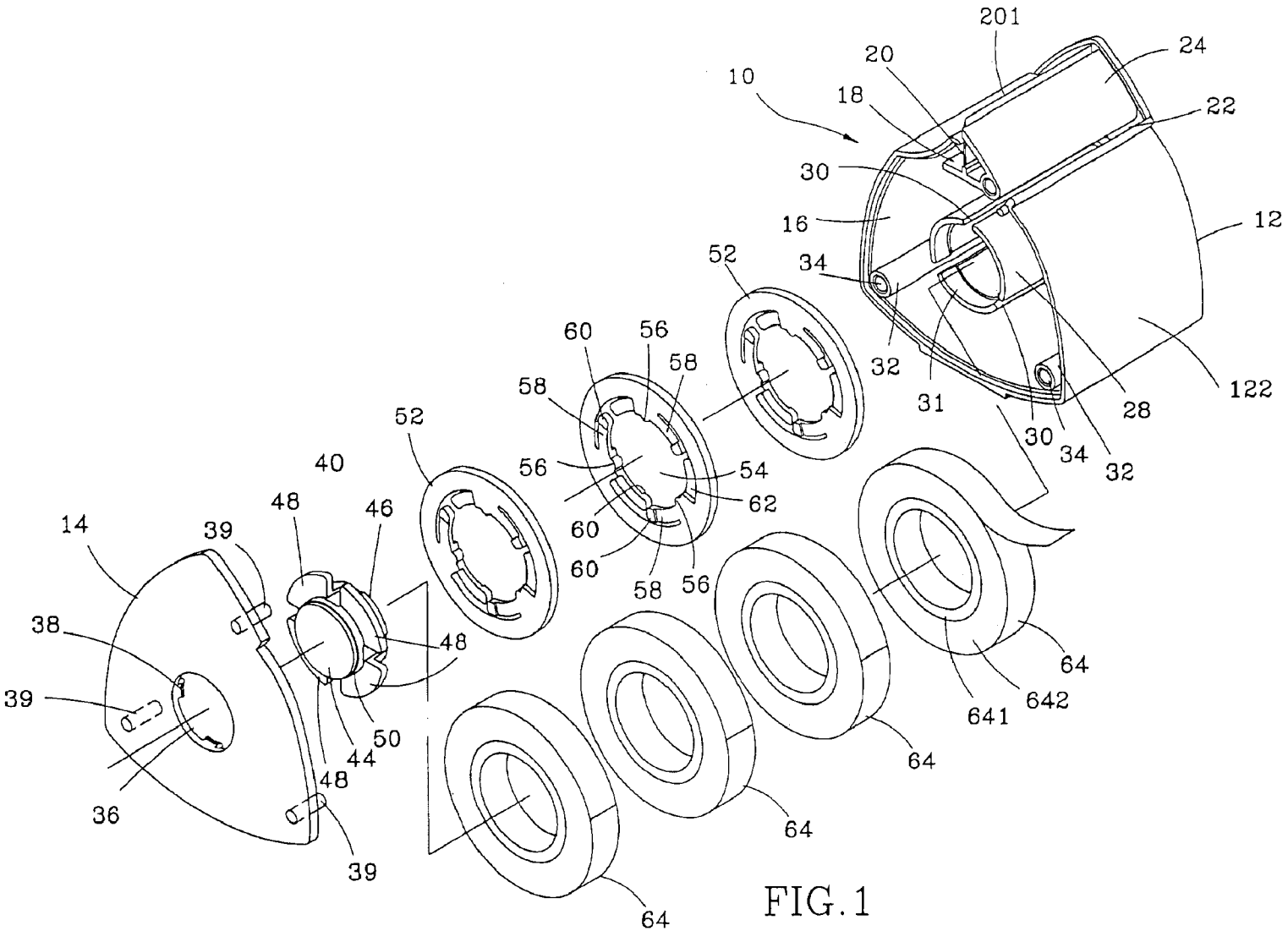
FIG. 1 is an exploded view of a preferred embodiment of the present invention.
Figure 2:
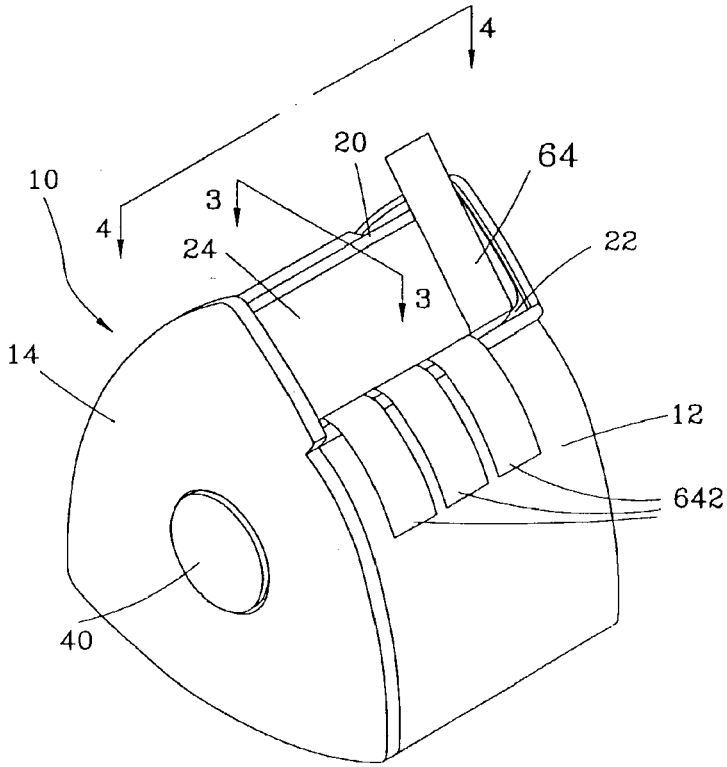
FIG. 2 is a perspective view of the preferred embodiment of the present invention.
Figure 3:
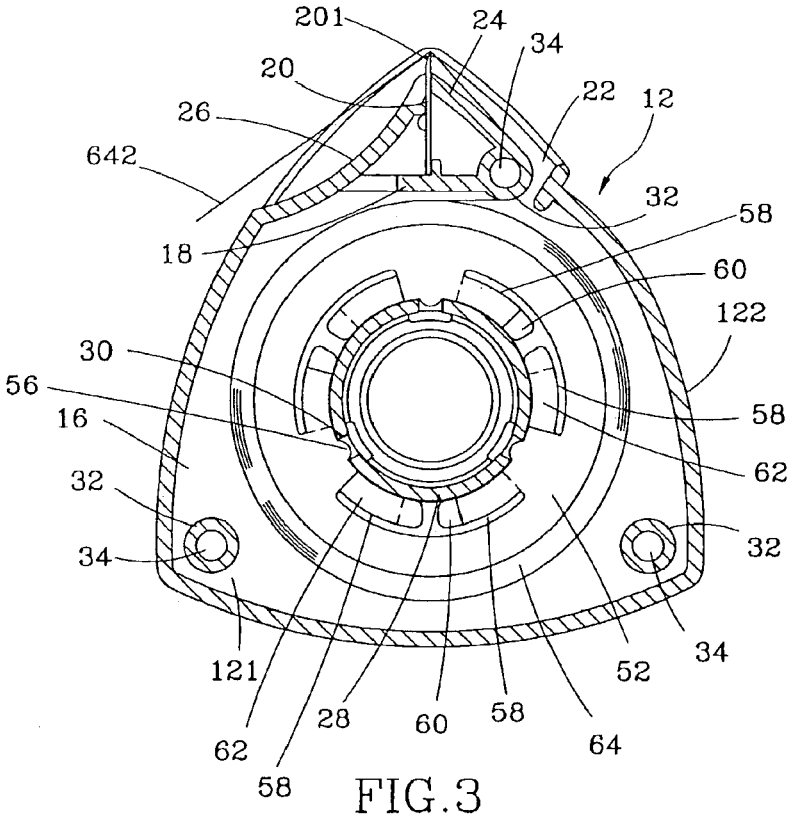
FIG. 3 is a sectional view along the 3—3 line in FIG. 2.

As shown in FIGS. from FIG. 1 to FIG. 3, a tape dispenser of the preferred embodiment of the present invention for four tape rolls installed therein comprises:

A housing 10 consists of a first casing 12 and a second casing 14. The first casing 12 is a triangle box in the present invention having a base wall 121 and a curved sidewall 122 in which a chamber 16 is formed. The first casing 12 has a cutter mount 18 at a corner of the chamber 16 on which a cutter 20 is mounted and the cutter 20 has a blade portion 201 at an end thereof that projects out of the first casing 12. The height of the blade portion 201 of the cutter 20 is lower than an edge of the base wall 121. The sidewall 122 has an outlet 22 beside the cutter mount 18, a plane 24 between the outlet 22 and the blade portion 201 of the cutter 20 and a concave surface 26 at the other side of the blade portion 201. The first casing 12 has a roll mount 28 at an inner side of the base wall 121 at which the tape rolls are installed. The roll mount 28 is a tube in the present invention projected from the base wall 121 and at a center of the chamber 16. The roll mount 28 has three gaps 30 extended along an axis orientation thereof and a slot 31 at an inner side of the tube's wall adjacent to a distal end thereof. The first casing 12 further has three coupling portions 32 at the corners of the camber 16 respectively, each one of which has a hole 34. The second casing 14 is a triangle plate in the present invention having a hole 36 at a center thereof, a plurality of flexible hooks 38 around the hole 36 and three posts 39 adjacent to corners thereof. The second casing 14 is coupled with the first casing 12 with the posts 39 inserted into the holes 34 of the coupling portions 32 to close the chamber 16.

A button 40 has an operative portion 44 at an end thereof, a connection portion 46 at the other end thereof, four driving portions 48 at a midsection thereof and radially projected outward and an annular flange 50 between the operative portion 44 and the driving portions 48. The button 40 is installed in the hole 36 of the second casing 14 with the flange 50 engaged with the hooks 38 and the connection portion 46 engaged with the slot 31 of the roll mount 28. The operative portion 44, therefore, is located at an outer surface of the second casing 14 and the driving portions 48 are located inside the second casing 14. There is a clearance between the button 40 and the second casing 14 so that the button 40 is movable between a first position, in which the button 40 is moved outward until the driving portions 48 are against the inner side of the second casing 14 (shown in FIG. 4), and a second position in which the button 40 is moved inward until the flange 50 is against the hooks 38 (shown in FIG. 5).

Three disks 52 respectively have a hole 54 at a center thereof and three projections 56 at an edge of the hole 54 and projected inward. The disk 53 further has a pair of flexible arms 58 between each two of the projections 56. Each arm 58 has a block 60 and a sag portion 62, wherein the block 60 is adjacent to a free end of the arm 58 and the blocks 60 on a pair of the arms 58 face opposite sides of the disk 52 respectively and the sag portions 62 are at sides of the arms 52 opposite from the blocks 60. The disks 52 are installed on the roll mount 28 between each two of the tape rolls 64 respectively with the projections 56 engaged with the gaps 30 so that the disks 52 are movable along the gaps 30 but not able to rotate.

In the present invention, four tape rolls 64 are installed on the roll mount 28 at the disks 52 are installed on the roll mount 28 between each two of the tape rolls 64 respectively. Each tape roll 64 has a root portion 641 and a tape 642 wound on the root portion 641.

Figure 4:
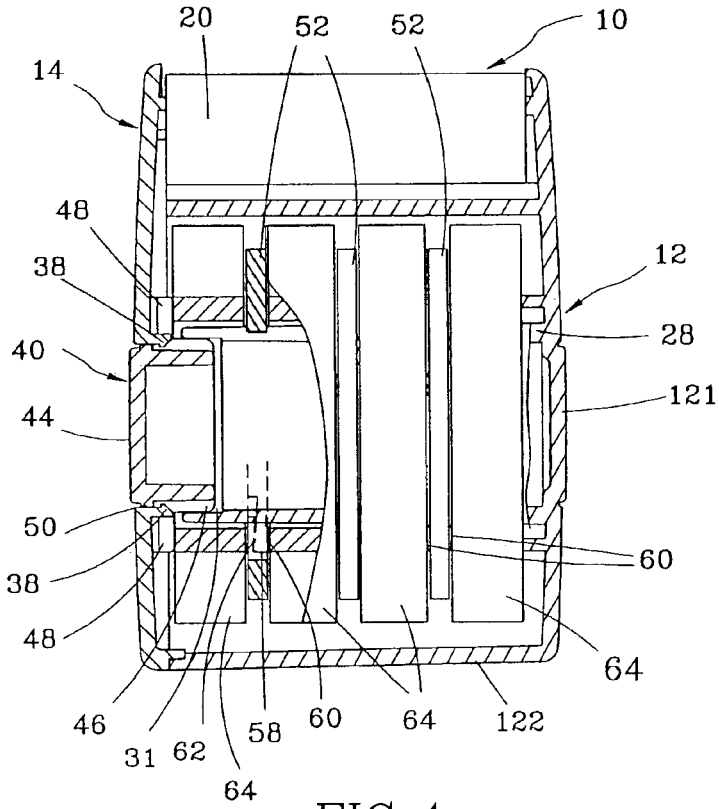
FIG. 4 is a sectional view along the 4—4 line in FIG. 2, showing the button unpressed and the tape rolls running freely.

The blocks 60 of the disk 52 are elastically against the root portions 641 of the neighboring tape rolls 64 respectively to keep the tape rolls 64 from each other, as shown in FIG. 4. The disks 52 now serve as separators to make tape rolls 64 being operated independently without interference.

Figure 5:
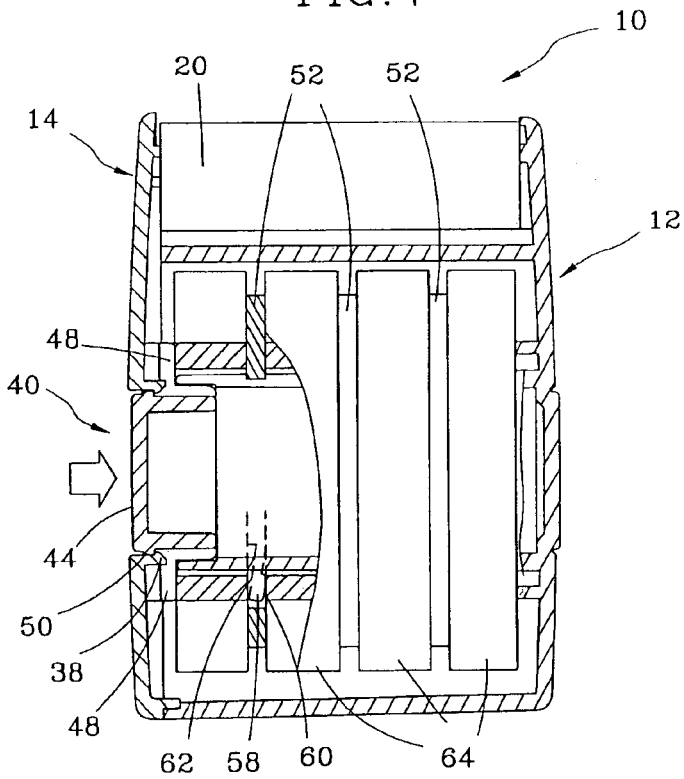
FIG. 5 is a sectional view similar to FIG. 4, showing the button being pressed and the tape rolls being braked.

While the button 40 is pressed inward, as shown in FIG. 5, the driving portions 48 press the outside tape roll 64 at the root portion 641 thereof to make the tape roll move inward. At this moment, the arms 58 of the disks 52 are bent forward so that the disks 52 have whole surfaces thereof against the neighboring tape rolls 64. In such condition, the disks 52 serve as brakes to prevent the tape rolls 64 from rotating any more. While the tape rolls 64 are braked, the cutter 20 would be easy to cut the tap 642 off and the tape 642 is no longer running back into the housing 10.

While the button 40 is released, the arms 58 of the disks 52 push the neighboring tape rolls 64 outward to make them separating again and back to the initial condition as shown in FIG. 4.

Hereunder are some characteristics of the present invention:

1. The sag portion 62 makes the arm 58 thinner so that there is no portion of the arm 58, including the block 60, projecting out of the disk 52 while the arm 58 is bent by pressing the button 40. The disks 52, therefore, have whole areas against the neighboring tape rolls 64 to increase the brake capacity. However, no projections of the disks 52 prevent the tape rolls 64 from being deformed while the disks 52 press the tape rolls 64.

2. The plane of the first casing 12 makes the tape 642 suspended above and that makes the tape 642 is easy to be cut off by the cutter 20.

3. The concave surface 26 of the first casing 12 is designed for user resting his/her fingers thereon but without any interference with the cutter 20 cutting the tape 642.

4. The tape dispenser of the present invention is provided to install two or more tape rolls therein. The numbers of the disks are according to how many tape rolls are installed therein.

5. The disks 52 of the present invention serve as the separators and brakes both. While they serve as brakes, there are three advantages of: 1) making the tap 642 easy to be cut; 2) avoiding the tape 642 from running back into the housing 10 after being cut and 3) making it easy for the user to decide the length of the tape 642 being cut off.

What is claimed is:

1. A tape dispenser for two or more tape rolls installed therein, comprising:

a housing having a first casing and a second casing coupled with each other in which a chamber is formed, wherein a roll mount is provided in the chamber, and wherein the housing has an outlet and a cutter mount on which a cutter is mounted, the cutter having a blade portion at an end of the cutter, the blade portion projecting out of the housing, and at least a disk having a hole at a center thereof to be engaged with the roll mount, wherein the disk has blocks respectively at opposite sides of the disk, the blocks being respectively situated against the tape rolls to separate the tape rolls from each other, wherein the disk has flexible arms and the blocks are respectively provided on the arms and said flexible arms and the blocks constituting a system to brake any of the installed tape rolls from movement.

2. The tape dispenser as defined in claim 1, wherein the arms are provided at the disk adjacent to the hole.

3. The tape dispenser as defined in claim 1, wherein the arm has a sag portion at a side opposite from the block.

4. The tape dispenser as defined in claim 1, further comprising a button movably provided in a hole of the second casing of the housing and having at least a driving portion within the chamber.

5. The tape dispenser as defined in claim 4, wherein the second casing has at least a hook adjacent to the hole and the button has a flange to be engaged with the hook.

6. The tape dispenser as defined in claim 4, wherein the button has a connection portion at an end thereof to be engaged with the roll mount.

7. The tape dispenser as defined in claim 1, wherein the roll mount has at least a gap and the disk has at least a projection to be engaged with the gap.

8. The tape dispenser as defined in claim 1, wherein the first casing of the housing has a base wall and a curved sidewall, and wherein the sidewall has a plane thereon between the outlet and the cutter and the plane is lower than the blade portion of the cutter.

9. The tape dispenser as defined in claim 1, wherein the first casing of the housing has a base wall and a curved sidewall, and wherein the sidewall has a concave surface beside the cutter.

* * * * *